US008900449B2

(12) United States Patent
Lin et al.

(10) Patent No.: US 8,900,449 B2
(45) Date of Patent: Dec. 2, 2014

(54) MAGNETIC FILTER FOR REFINING AND CHEMICAL INDUSTRIES

(75) Inventors: Tzong-Bin Lin, Chia-Yi (TW); Fu-Ming Lee, Katy, TX (US); Jeng-Cheng Lee, Chia-Yi (TW); Fred G. Tahmassi, Plano, TX (US); Benjamin Poi Chen, Taipei (TW); Tsung-Min Chiu, Taipei (TW); Kuang-Yeu Wu, Plano, TX (US)

(73) Assignees: CPC Corporation, Taiwan, Taipei (TW); AMT International, Inc., Plano, TN (US)

( * ) Notice: Subject to any disclaimer, the term of this patent is extended or adjusted under 35 U.S.C. 154(b) by 506 days.

(21) Appl. No.: 13/419,407

(22) Filed: Mar. 13, 2012

(65) Prior Publication Data

US 2013/0240455 A1 Sep. 19, 2013

(51) Int. Cl.

| | |
|---|---|
| ***B03C 1/02*** | (2006.01) |
| ***B03C 1/26*** | (2006.01) |
| ***B03C 1/30*** | (2006.01) |
| ***B03C 1/28*** | (2006.01) |

(52) U.S. Cl.

CPC ..... *B03C 1/286* (2013.01); *B03C 2201/28* (2013.01); *B03C 2201/18* (2013.01); *B03C 1/30* (2013.01)

USPC ..... 210/223; 210/222; 210/695

(58) Field of Classification Search

USPC ..... 210/222, 223, 695

See application file for complete search history.

(56) References Cited

U.S. PATENT DOCUMENTS

| | | | |
|---|---|---|---|
| 2,789,655 | A | 4/1957 | Michael |
| 3,139,403 | A | 6/1964 | Cramer |
| 3,712,472 | A | 1/1973 | Elliott |
| 4,722,788 | A | 2/1988 | Nakamura |
| 4,946,589 | A | 8/1990 | Hayes |
| 5,043,063 | A | 8/1991 | Latimer |
| 5,217,610 | A | 6/1993 | McClain et al. |
| 5,427,249 | A | 6/1995 | Schaaf |
| 5,470,466 | A | 11/1995 | Schaaf |
| 5,819,949 | A | 10/1998 | Schaaf |

(Continued)

FOREIGN PATENT DOCUMENTS

| | | |
|---|---|---|
| EP | 0501033 | 9/1992 |
| GB | 850233 | 10/1960 |

(Continued)

OTHER PUBLICATIONS

PCT/US2013/028781 International Search Report May 23, 2013.

*Primary Examiner* — David A Reifsnyder

(74) *Attorney, Agent, or Firm* — Cascio & Zervas

(57) ABSTRACT

A magnetic filter employs a magnetic core assembly that incorporates a plurality of exchangeable holder sleeves, each enclosing permanent magnets. Neither the sleeves nor magnetic bars are mechanically fixed to the filter housing. The magnet bars and holder sleeves are individually accessible. The number of holder sleeves in the magnetic core assembly is flexible. The magnetic filter in equipped with a screen that partially encloses the elongated holder sleeves to treat streams that contain degradation sludge, iron containing particles or flakes, and non-magnetic polymeric materials. In operation, a feed stream initially contacts the magnetic core assembly where paramagnetic contaminants become deposited onto the exterior surface of the holder sleeves under direct influence of strong magnetic field generated by the magnet bars. The mesh screen cylinder subsequently captures non-magnetic and weakly magnetic contaminants of a certain size before the cleaned stream exits the magnetic filter.

22 Claims, 2 Drawing Sheets

(56) References Cited

U.S. PATENT DOCUMENTS

| | | | | |
|---|---|---|---|---|
| 6,056,879 | A | 5/2000 | Schaaf | |
| 6,077,333 | A | 6/2000 | Wolfs | |
| 6,355,176 | B1 | 3/2002 | Schaaf | |
| 6,730,217 | B2 | 5/2004 | Schaaf | |
| 7,597,015 | B2 | 10/2009 | Harley | |
| 8,636,907 | B1 * | 1/2014 | Lin et al. | 210/695 |
| 2009/0272702 | A1 | 11/2009 | Yen et al. | |
| 2010/0065504 | A1 | 3/2010 | Yen et al. | |

FOREIGN PATENT DOCUMENTS

| | | | |
|---|---|---|---|
| WO | 8705536 | A1 | 9/1987 |
| WO | 2007/031984 | A1 | 3/2007 |
| WO | 2011/143688 | A1 | 11/2011 |
| WO | WO 2013138093 | A1 * | 9/2013 |

* cited by examiner

FIG. 2B
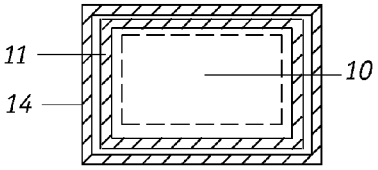
FIG. 2D
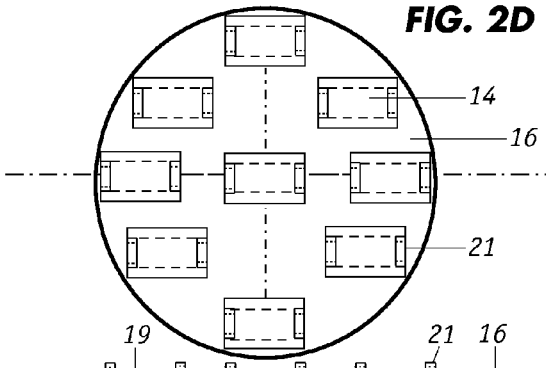
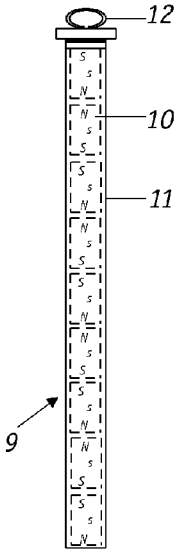
FIG. 2A
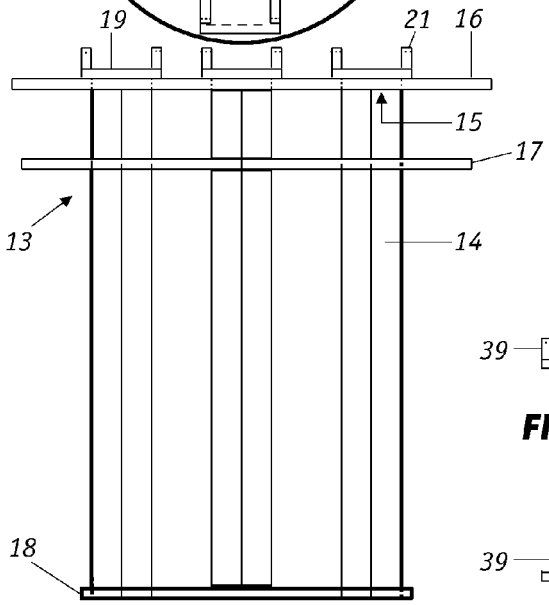
FIG. 2C
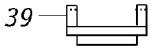
FIG. 2E
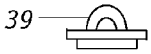
FIG. 2F
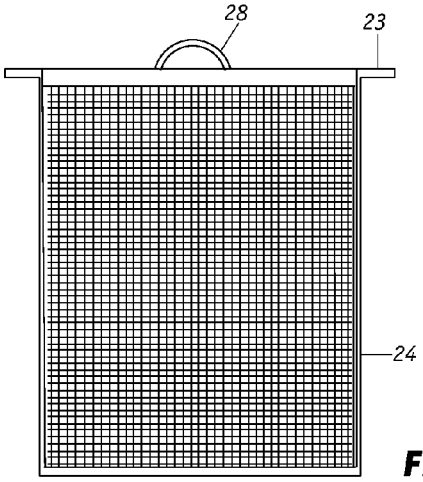
FIG. 3A
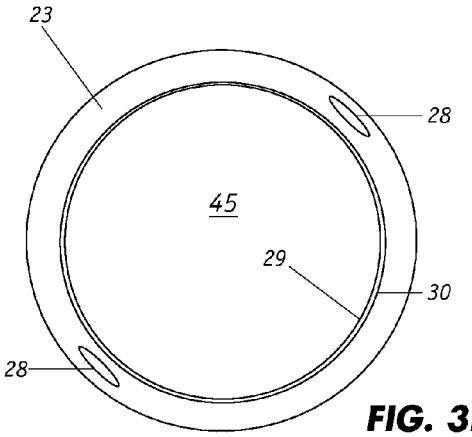
FIG. 3B

MAGNETIC FILTER FOR REFINING AND CHEMICAL INDUSTRIES

BACKGROUND OF THE INVENTION

Filters employing permanent magnets as the filter medium are prevalent in the prior art. Exemplary magnetic filtering devices as described for instance in U.S. Pat. No. 2,789,655 to Michael et al., U.S. Pat. No. 3,139,403 to Cramer et al., U.S. Pat. No. 5,043,063 to Latimer, and GB 850,233 typically enclose the magnets in fixed rods or columns that are secured permanently to the housing and are difficult to service. Some filtration devices are augmented with filter screens to remove sludge as disclosed in U.S. Pat. No. 4,946,589 to Hayes. Internal sprayers are often required to clean and removed the contaminants as shown in U.S. Pat. No. 6,077,333 to Wolfs. Recently, U.S. Pat. No. 6,730,217 to Schaaf el al. disclose a magnetic filter with a removable magnetic core assembly which consists of permanent magnet bars carried within non-magnetic insulation tubes.

A major drawback of current magnetic filtration apparatuses is that they are difficult to service in part because in many instances the entire core assembly containing all the permanent magnet bars and the protective tubes must be removed from the filter housing simultaneously. In other configurations, all the magnet bars must to be withdrawn together from all the tubes since the individual insulation tubes are inaccessible. As a result, it is inconvenient and expensive to replace the magnet bars or insulation tubes, and in extreme cases a whole core assembly must to be replaced just to service one or a few un-repairable magnet bars and/or tubes. Power equipment or mechanical tools are required for the operation due to the weight of the core assembly. Another deficiency is that the number of insulating tubes in the filtration device tends to be fixed and cannot be adjusted as needed.

SUMMARY OF THE INVENTION

The present invention is based in part on the development of a versatile and robust magnetic filter that includes a magnetic core assembly which comprises of a plurality of exchangeable elongated holder sleeves each configured to enclose one or more permanent magnets therein and a plate support assembly. Neither the sleeves nor the magnet bars are mechanically fixed to the filter housing by screws, bolts, welding, or the like so that each is removable manually. Thus, the magnet bars and holder sleeves can be repaired or replaced individually. A corollary is that the number of holder sleeves in the magnetic core assembly is flexible to meet the needs of specific applications. The magnetic filter is particular suited for treating process streams that contain degradation sludge, iron containing particles or flakes, as well as non-magnetic polymeric materials.

Accordingly, in one aspect, the invention is directed to a magnetic filter for separating magnetic and non-magnetic contaminants from a liquid process stream in a refinery or a chemical plant that includes:

- a housing having an opening that is sealed with a removable cover, a process stream inlet and a process stream outlet, and an interior region between the inlet and outlet;
- a magnetic core assembly which is detachably positioned in the interior and that includes:
  - a magnet support assembly having at least one support plate; and
  - a plurality of elongated non-magnetic sleeves that are removably disposed in the magnet support assembly with each elongated sleeve being vertically orientated and spaced apart from one another and each elongated sleeve configured to accommodate one or more magnets that are disposed therein;
- a screen having an upper rim and enclosing a lower portion of the magnet core assembly wherein the screen is configured to capture contaminants thereon; and
- a plate support assembly secured in the interior of the housing and defining upper and lower support perimeters such that the upper rim of the screen is positioned on the lower support perimeter and a support plate of the magnetic core assembly is positioned on the upper support perimeter, wherein the support plate of the magnetic core assembly and the upper rim of the screen forms a flow channel so that as the liquid process stream flows from the inlet to the outlet, the liquid travels through the channel, passes the elongated non-magnetic sleeves so that magnetic contaminants adhere to the exterior of the non-magnetic sleeve and finally through the screen where contaminants of the desired sized are removed to form a treated liquid process stream that leaves the interior via the outlet.

In operation, a feed stream initially interacts with the magnetic core assembly where paramagnetic contaminants are attracted by the magnetic field generated by the magnets and the contaminants become deposited onto the exterior surface of the holder sleeves. The mesh screen cylinder subsequently captures non-magnetic and weakly magnetic contaminants of a certain size before the cleaned stream exits the magnetic filter. In servicing the magnetic filter, after rotating the hinged cover, the components can be freely removed from the interior of the housing, that is, without having to first disengage or unlock any mechanical securing mechanism. For instance, the magnet bars can be readily separated from each sleeve; or individual elongated non-magnetic sleeves can be lifted from the magnet support assembly. Furthermore, the magnet support assembly can be lifted from the interior to remove all of the elongated non-magnetic sleeves collectively.

BRIEF DESCRIPTION OF THE DRAWINGS

FIG. 2A is a cross sectional view taken along the length of the magnet bar assembly;

FIG. 2B is the top view of the magnetic bar and holder sleeve assembly

FIG. 2C is a side view of the holder sleeve assembly;

FIG. 2D is a top view of the holder sleeve assembly;

FIG. 2E is a side view of the holder sleeve plug and FIG. 2F is a side view of the hold sleeve plug of FIG. 2E rotated about 90 degrees; and FIGS. 3A and 3B are side and top views of the screen cylinder.

DETAILED DESCRIPTION OF THE PREFERRED EMBODIMENTS

Figure 1:
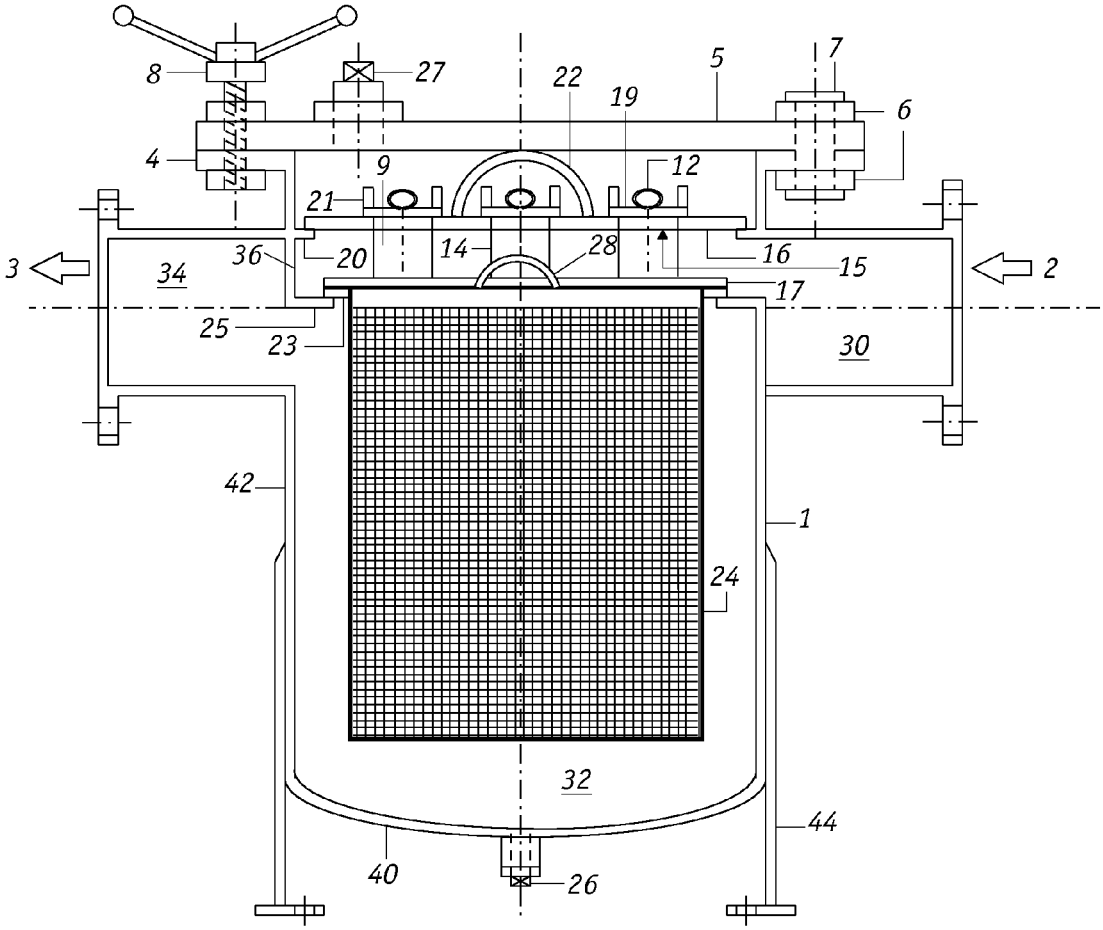
FIG. 1 is a cross sectional view of the magnetic filter.

The invention is directed to a magnetic filter that removes paramagnetic particles or sludge, and at least a portion of the non-magnetic sludge from liquid petroleum or chemical process streams, especially streams that contain organic solvents and by-products. Carbon steel, a common material for plant construction, tends to corrode in the presence of acidic contaminants in process streams of refineries or chemical plants. The corrosion generates ferrous ions which react with sulfur, oxygen and water to form paramagnetic FeS, FeO, $Fe(OH)_2$, $Fe(CN)_6$, and the like in the form of fine particles or visible flakes. These paramagnetic materials tend to attract degradation sludge, which may be organic by-products, thereby rendering a major portion of the contaminants paramagnetic. It has been demonstrated that a substantially large portion of the contaminants can be removed from a process stream by employing one or more permanent magnets. The remaining contaminants which are not attracted by the magnets consist primarily of non-magnetic (or weakly-magnetic) particles that do not respond sufficiently to the magnetic fields from the magnets. The magnetic filter of the present invention is particularly suited for treating contaminated process streams wherein the majority of the contaminants in the stream comprise magnetic contaminants. In this fashion, the remaining small amount of non-magnetic contaminants in the process stream downstream from the initial magnetic filtration stage can be readily separated in a subsequent second stage that employs one or more filter screens.

The magnetic filter as shown in FIG. 1 includes an enclosure or housing 1 having a bevel-shaped base 40 and vertical peripheral walls 42 that are secured to mounting legs 44. Housing 1 defines an interior region 32 that is accessible preferably from opposite horizontal ends or plenums 30, 34 of housing 1. In this fashion, the magnetic filter can be readily incorporated into the straight section of existing piping that transports a contaminated stream in a refinery or chemical plant. For example, a length of piping can be removed to form two ends: (1) the upstream end from which process stream flows is welded to inlet section 2 of housing 1 and (2) the downstream end of the pipe is similarly secured to outlet section 3 of housing 1. As further described herein, the configuration within interior 32 directs the process stream entering magnetic filter housing 1 to initially traverse through the magnetic core assembly that attracts magnetic contaminants and to subsequently encounter a screen cylinder that strains non-magnetic and weekly magnetic contaminants therefrom before exiting the filter housing as a treated stream.

The outer perimeter of top opening of housing 1 is encircled by flange 4, on which a cover 5 is fitted and connected at one end with collars 6 that are fastened with a fitting pin 7. Cover 5 thus swings open horizontally around fitting pin 7 or other hinge mechanism. The other end of cover 5 is securely attached to flange 4 by a hand operated screw 8 that is equipped with handle bars or other fastening device that preferably does not require mechanical or power tools. A polymer gasket or other suitable sealing means may be inserted between cover 5 and flange 4 to insure a tight fit during the filtration operations. Magnetic filter housing 1 is equipped with a drain valve 26 at the bottom for periodical discharge and with a safety relief valve 27 for relieving excess pressure before opening cover 5 for service of the unit including clean out. A flexible metal band 22, which is attached to top supporting plate 16, facilitates the removal of either the entire magnetic core assembly or of the holder sleeve plate assembly 13 (FIG. 2C) (with or without the holder sleeves 14) from filter housing 1.

FIG. 2A depicts the vertical cross sectional view of a magnet bar assembly 9 that includes a plurality of stacked magnet bars each of which preferably consists of a short permanent magnet block or cylinder 10 with north and south poles. The plurality of magnet bars 10 is arranged so that like poles of adjacent magnets are positioned next to each other. The individual magnet bars 10 are fitted into a sealed non-magnetic tubular enclosure 11 which has a pulling ring 12 on top. Each magnet bar assembly 9 is inserted into a separate holder sleeve 14. As described further herein, magnetic contaminants will adhere to the exterior surface of holder sleeve 14 during the filtration process. FIG. 2B depicts the cross sectional top view showing the inner position of magnet block 10, mid-position tubular enclosure 11 and outer position of magnet bar holder sleeve 14. While magnet block 10 has a rectangular cross section, it is understood that the shape of the magnet block 10 and the corresponding tubular enclosure 11 and hold sleeve 14 can have any suitable exterior configuration.

FIG. 2C illustrates the arrangement of a plurality of spaced-apart elongated holder sleeves 14 as they are secured on a holder sleeve assembly 13 which includes three parallel supporting plates 16, 17, and 18. Each holder sleeve 14 is preferably equipped with two pulling handles 21 so that the holder sleeves can be freely lifted from the plate assembly 13 after the magnet bar assembly 9 has been withdrawn from the holder sleeve during the clean-up cycle. Upper support and middle support plates 16, 17 have apertures or holes 15 that are sized and aligned so that a holder sleeve 14 can readily fit into the apertures 15 and rest on the surface of lower support plate 18. A top lid or rim cover 19 that is attached to the open end of each holder sleeve 14 and that has a diameter that is larger than that of the fitted hole 15 supports each sleeve 14 at the top supporting plate 16. Top supporting plate 16 bears the entire weight of the plurality of magnet bar assemblies 9 and their associated holder sleeves 14. In addition, top support plate 16 shields the open end of each holder sleeve 14 and, therefore each magnet bar assembly 9 as well, from coming into direct contact with the process fluid during the operation. Middle plate 17, as further described herein, secures a screen cylinder 24 (FIG. 1) in place by pressing it against a supporting ring 25 (FIG. 1) which is permanently connected to filter housing 1. Bottom plate 18 secures the lower portions of the plurality of holder sleeves 14.

At least one of the elongated holder sleeves 14 (preferably the middle one) is stationary and rigidly secures each of the three supporting plates 16, 17, and 18 so that the plates remain parallel and vertically spaced-apart and provide structural integrity to holder sleeve assembly 13. As is apparent, the elongated holder sleeve 14 which secures the supporting plates is stationary integral with the magnetic bar and holder sleeve assembly 13. Instead of using a stationary holder sleeve to secure the plates, one or more rigid rods can be employed.

FIG. 2D shows the top view of the holder sleeve assembly depicting an array of evenly distributed holder sleeves 14 that are inserted through holes 15 (FIG. 2C) on top support plate 16. In the case of treating a stream that is heavily contaminated with paramagnetic materials, each available hole 15 has a holder sleeve 14 inserted therein so as to expose the stream to maximum magnetic field strength in order to attract the paramagnetic particles. The flow rate through the magnetic filter may have to be reduced in order to increase the residence time. In situations where the stream is not heavily contaminated, it may not be necessary to fully equip the holder sleeve assembly with magnet bars. Incorporating fewer magnet bars allows the magnetic filter to accommodate larger process stream flow rates. In this scenario, not all the holes 15 on upper support plate 16 will be occupied by a holder sleeve 14 rather, some holes 15 will simply be stop up with a plug that is preferably made of a paramagnetic material such carbon steel and that has the same shape and dimensions as that of top cover 19 for the holder sleeves 14. When magnet bars are required for a different application, the plugs can then be replaced by holder sleeves that carry additional magnet bars. A representative side view of a plug 39 is shown in FIG. 2E and a 90° rotated side view of the plug is shown in FIG. 2F.

FIGS. 3A and 3B depict hollow screen cylinder 24 that is constructed of a suitably sized metal material with pores that permit passage of fluids and particles of a certain size. The cylinder defines a chamber 45 that preferably has a flat base so that captured particles accumulate evenly at the bottom. Screen cylinder 24 preferably includes two layers of non-magnetic metal screens with a finer screen of a mesh size of 1 to 200 (wires per inch), preferably of a mesh size of 10-100 for the inner layer 29 and with a coarser screen of a mesh size of 10-100, preferably of a mesh size of 10-50 for the outer layer 30. Screen cylinder 24 includes two handle bars 28 that are attached to upper protruding rim 23.

Referring to FIG. 1, in assembling the magnetic filter, screen cylinder 24 is first lowered into interior 32 of housing 1 with the underside of outer rim 23 being positioned on the upper surface of supporting ring 25 which is welded onto the filter housing. Thereafter, magnetic core assembly 13 (FIG. 2C) is positioned partially inside the chamber of the screen cylinder such that middle support plate 17 comes to rest on the upper surface of rim 23 while the lower surface of upper support plate 16 comes to rest on supporting ring 20, which is also welded onto the upper part of housing 1. A gasket can also be positioned between support plate 16 and ring 20. In this arrangement, a screen cylinder 24 partially encloses the magnetic core assembly so that the ends of the elongated of the holder sleeves 14 (FIG. 2C) are entirely situated within the chamber of hollow screen cylinder 24. In addition, the space between supporting plates 16 and 17 define a channel through which process stream fluid enters; wall 36 that flanks the downstream end of this channel diverts the fluid downward into the chamber of cylinder 24.

Top cover 19 on the holder sleeves 14 and top supporting plate 16, and the supporting ring 20 are preferably made from paramagnetic materials, such as carbon steel. With each holder sleeve 14 (FIG. 2C) being equipped with a magnet bar assembly 9 (FIG. 2A), the holder sleeves 14 generates strong magnetic forces from the magnet bars that helps keep the top supporting plate 16 as well as all the holder sleeves 14 securely in position. A gasket can be positioned between hole 15 and top cover 19 to provide a better seal.

Flexible metal band 22 that is secured to top supporting plate 16 also functions as a metal biasing spring that presses top support plate 16 against supporting ring 20 and presses middle plate 17 against top rim 23 of screen cylinder 24. This feature keeps both the plate assembly 13 and screen cylinder 24 securely in place when top cover 5 of the filter housing is closed and compresses against metal band 22.

In operation, after contaminated process stream 2 enters the magnetic filter paramagnetic materials in the stream are attracted by the strong magnetic fields within the magnetic core assembly. These materials adhere to the outer surfaces of plurality of the holder sleeves 14. Within the chamber of screen cylinder 24, the process stream travels in an axial direction that is parallel to the axis of the elongated holder sleeves 14 and in a radial, transverse direction. The direction of flow will depend on the pressure gradients that develop as contaminants build up within the magnetic core assembly. It is expected that most of the paramagnetic materials will have been removed by the magnetic filter. Subsequently, both non-paramagnetic and weakly paramagnetic materials of a certain size and that are still in the process stream will be captured as the fluid passes through screen cylinder 24. The cleaned process stream which is substantially free of both paramagnetic and non-paramagnetic contaminants exits the magnetic filter via exit outlet section 3.

After the holder sleeves 14 becomes loaded with magnetic contaminants and the screen cylinder 24 becomes loaded with non-magnetic contaminants, inlet 2 and outlet 3 of the magnetic filter are valve shut. Top cover 5 is opened for the removal of the various components for cleaning. Preferably the parts are removed in reversed order with holder sleeve assembly 13 (FIG. 2C) being freely lifted from the interior. Removing the magnetic bars from the holder sleeve assembly releases the attractive magnetic force that helped keep the paramagnetic components aligned and drawn to each other thereby allowing the paramagnetic contaminants to drop off from the exterior surface of the holder sleeves. Alternatively, individual magnet bars 9 can be freely separated from their holder sleeves 14 or individual holder sleeves 14 can be freely lifted from top supporting plate 16.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A magnetic filter for separating magnetic and non-magnetic contaminants from a liquid process stream in a refinery or a chemical plant that comprises:

a housing having an opening that is sealed with a removable cover, a process stream inlet and a process stream outlet, and an interior region between the inlet and outlet;

a magnetic core assembly which is detachably positioned in the interior and that comprises:

a magnet support assembly having at least one support plate; and a plurality of elongated non-magnetic sleeves that are removably disposed in the magnet support assembly with each elongated sleeve being vertically orientated and spaced apart from one another and each elongated sleeve configured to accommodate one or more magnets that are disposed therein;

a screen having an upper rim and enclosing a lower portion of the magnet core assembly wherein the screen is configured to capture contaminants thereon; and a plate support assembly secured in the interior of the housing and defining upper and lower support perimeters such that the upper rim of the screen is positioned on the lower support perimeter and a support plate of the magnetic core assembly is positioned on the upper support perimeter, wherein the support plate of the magnetic core assembly and the upper rim of the screen forms a flow channel so that as the liquid process stream flows from the inlet to the outlet, the liquid travels through the channel, passes the elongated non-magnetic sleeves so that magnetic contaminants adhere to the exterior of the non-magnetic sleeve and finally through the screen where contaminants of the desired sized are removed to form a treated liquid process stream that leaves the interior via the outlet.

2. The magnetic filter of claim 1 wherein the one or more magnets in each elongated non-magnetic sleeve are encased in a non-magnetic tubular enclosure that is sealed at its lower end and the tubular enclosure is slidably received within the elongated sleeve.

3. The magnetic filter of claim 2 characterized in that upon removable of the cover (1) each tubular enclosure can be independently lifted from its respective elongated non-magnetic sleeve and (2) all of the elongated sleeves with their respective magnets can be collectively lifted from the interior by removing the magnet support assembly.

4. The magnetic filter of claim 3 wherein the magnet support assembly can be lifted without having to first disengage any first securing mechanism and upon removable of magnet support assembly, the screen can be lifted from the interior without having to first disengage any second securing mechanism.

5. The magnetic filter of claim 1 wherein the magnetic core assembly includes an upper support plate that is made of paramagnetic material and that is positioned on the upper support perimeter such that attractive forces secure the upper support plate to the upper support perimeter.

6. The magnetic filter of claim 5 wherein the magnetic core assembly further includes a lower support plate that is vertically disposed and spaced apart from the upper support plate and wherein upper support plate and lower support plates are secured to at least one of the elongated sleeves that is an integral part of the magnetic core assembly.

7. The magnetic filter of claim 1 wherein the liquid process stream flows through the magnetic core assembly in a substantially axial direction parallel to the plurality of elongated non-magnetic sleeves.

8. The magnetic filter of claim 1 wherein the screen comprises an inner finer screen with a mesh size 1 to 200 and an outer coarser screen with a mesh size of 10 to 100 with both screens being made of a non-magnetic metal.

9. The magnetic filter of claim 8 wherein the finer screen has a mesh size of 10 to 100 and the coarser screen has a mesh size of 10 to 50.

10. The magnetic filter of claim 8 wherein the screen comprises a plurality of mesh screens with each screen having pores that capture certain sized magnetic and non-magnetic contaminants.

11. The magnetic filter of claim 1 configured as a two-stage filtration apparatus wherein the magnetic core assembly attracts a substantial portion of the magnetic contaminants that are present in the liquid process stream from the inlet to yield an initially treated liquid process stream and thereafter the screen captures magnetic and non-magnetic contaminants of a desired size to yield a filtered liquid process stream that exits through the outlet.

12. The magnetic filter of claim 1 wherein the plurality of elongated sleeves form an array of the sleeves that are spaced part to form a plurality of evenly distributed channels through which the process stream flows.

13. A method of removing magnetic and non-magnetic particles from a liquid process stream in a refinery or a chemical plant that comprises the steps of:

(a) providing a magnetic filter device that comprises:

a housing having an opening that is enclosed by a detachable cover, an inlet that is connected to the liquid stream and an outlet, and an interior region between the inlet and outlet;

a magnetic core assembly which is detachably positioned in the interior and that comprises:

a magnet support assembly having one or more support plates; and a plurality of elongated non-magnetic sleeves that are removably disposed in the magnet support assembly with each elongated sleeve being vertically orientated and spaced apart from one another and each sleeve is configured to accommodate one or more magnets disposed therein;

a screen having an upper rim and enclosing a lower portion of the magnet core assembly wherein the screen is configured to capture contaminants thereon; and a plate support assembly secured in the interior region defining upper and lower support perimeters such that the upper rim of the screen is positioned on the lower support perimeter and a support plate of the magnetic core assembly is positioned on the upper perimeter, wherein the support plate of the magnetic core assembly and the upper rim of the screen define a flow channel so that as the liquid process stream flows from the inlet to the outlet, the liquid travels through the channel, passes the elongated non-magnetic sleeves where magnetic contaminants adhere to the non-magnetic sleeves and finally through the screen where non-magnetic contaminants are removed to form a treated liquid process stream that leaves the via the outlet;

(b) allowing flow of the liquid process stream through the device to treat the liquid process stream;

(c) terminating the flow of liquid process stream; and (d) removing the cover to service the magnetic filtering device characterized in that the magnet bars which are disposed in each sleeve can be removed from their respectively sleeves, individual elongated non-magnetic sleeves can be lifted from the magnet support assembly, and the magnet support assembly can be lifted from the interior to remove all of the elongated non-magnetic sleeves collectively.

14. The method of claim 13 wherein the one or more magnets that are disposed in each elongated sleeves are encased in a non-magnetic tubular enclosure that is sealed at its lower end and the tubular enclosure is slidably received within the elongated sleeve.

15. The method of claim 14 herein each step in step (e) of removing the magnetic bars, lifting the individual elongated non-magnetic sleeves, and lifting of the magnet support assembly is executed freely without first having to disengaged any securing mechanism.

16. The method of claim 13 wherein magnetic contaminants fall from the elongated sleeves into the screen when a magnet bar is removed from an elongated sleeve.

17. The method of claim 16 whereby after removable of the support assembly, the screen containing contaminants is freely lifted from the interior.

18. The method of claim 13 wherein step (e) is further characterized in that the screen and magnet support assembly can be freely lifted from the interior either sequentially or simultaneously.

19. The method of claim 13 wherein the liquid process stream comprises an organic solvent.

20. The method of claim 13 wherein the magnetic core assembly includes an upper support plate that is made of paramagnetic material and that is positioned on the upper support perimeter such that attractive forces secure the upper support plate to the upper support perimeter.

21. The method of claim 13 wherein the magnetic core assembly attracts a substantial portion of the magnetic contaminants that are present in the liquid process stream from the inlet to yield an initially treated liquid process stream and thereafter the screen captures magnetic and non-magnetic contaminants of a desired size to yield a filtered liquid process stream that exits through the outlet.

22. The method of claim 21 wherein the screen comprises a plurality of mesh screens with each screen having pores that capture certain sized magnetic and non-magnetic contaminants.

* * * * *